United States Patent [19]

Oberpriller et al.

[11] 4,237,695

[45] Dec. 9, 1980

[54] METHOD OF AND APPARATUS FOR THE COOLING OF ARTICLES OR MATERIALS

[75] Inventors: Jakob Oberpriller, Baierbrunn; Alfred Schuster, Bornheim-Waldorf; Dolf D. Hofmann, Munich, all of Fed. Rep. of Germany

[73] Assignee: Linde Aktiengesellschaft, Wiesbaden, Fed. Rep. of Germany

[21] Appl. No.: 52,973

[22] Filed: Jun. 28, 1979

Related U.S. Application Data

[63] Continuation of Ser. No. 850,802, Nov. 11, 1977, abandoned.

[30] Foreign Application Priority Data

Nov. 13, 1976 [DE] Fed. Rep. of Germany ..... 2651871

[51] Int. Cl.[3] ..... F25D 13/06

[52] U.S. Cl. ..... 62/63; 62/375; 62/380; 62/332

[58] Field of Search ..... 62/63, 373, 374, 375, 62/380, 332

[56] References Cited

U.S. PATENT DOCUMENTS

| | | | |
|---|---|---|---|
| 2,286,225 | 6/1942 | Noyes | 62/64 |
| 3,024,117 | 3/1962 | Barlow | 62/63 |
| 3,238,736 | 3/1966 | MacIntosh | 62/63 |
| 3,427,820 | 2/1969 | Hart | 62/374 |
| 3,507,128 | 4/1970 | Murphy et al. | 62/332 |
| 3,603,102 | 9/1971 | Banas | 62/64 |
| 3,681,851 | 8/1972 | Fleming | 62/85 |
| 3,871,185 | 3/1975 | Harper et al. | 62/63 |
| 3,881,322 | 5/1975 | LeDiouron | 62/63 |
| 3,934,987 | 1/1976 | Bivins, Jr. | 62/52 |
| 3,952,540 | 4/1976 | Okada et al. | 62/374 |
| 3,982,404 | 9/1976 | Overbye | 62/63 |
| 4,072,026 | 2/1978 | Oberpriller et al. | 62/63 |
| 4,075,869 | 2/1978 | Fitsall | 62/374 |

FOREIGN PATENT DOCUMENTS 2017876 10/1971 Fed. Rep. of Germany .

*Primary Examiner*—Ronald C. Capossela
*Attorney, Agent, or Firm*—Karl F. Ross

[57] ABSTRACT

A method of and an apparatus for the cooling of articles or materials in which the objects to be cooled are passed in succession through a precooling zone and a deep-cooling zone. A first cold-gas stream traverses the pre-cooling zone in counterflow to the objects and is cooled by indirect heat exchange with a refrigerant while the objects in the deep cooling zone are cooled by direct heat exchange with a second gas stream produced by gasification of a liquefied gas. The second cooling-gas stream, after at least partial heat exchange with the objects or materials in the deep-cooling zone, is fed to the first gas stream prior to the cooling thereof by the indirect heat exchange.

8 Claims, 1 Drawing Figure

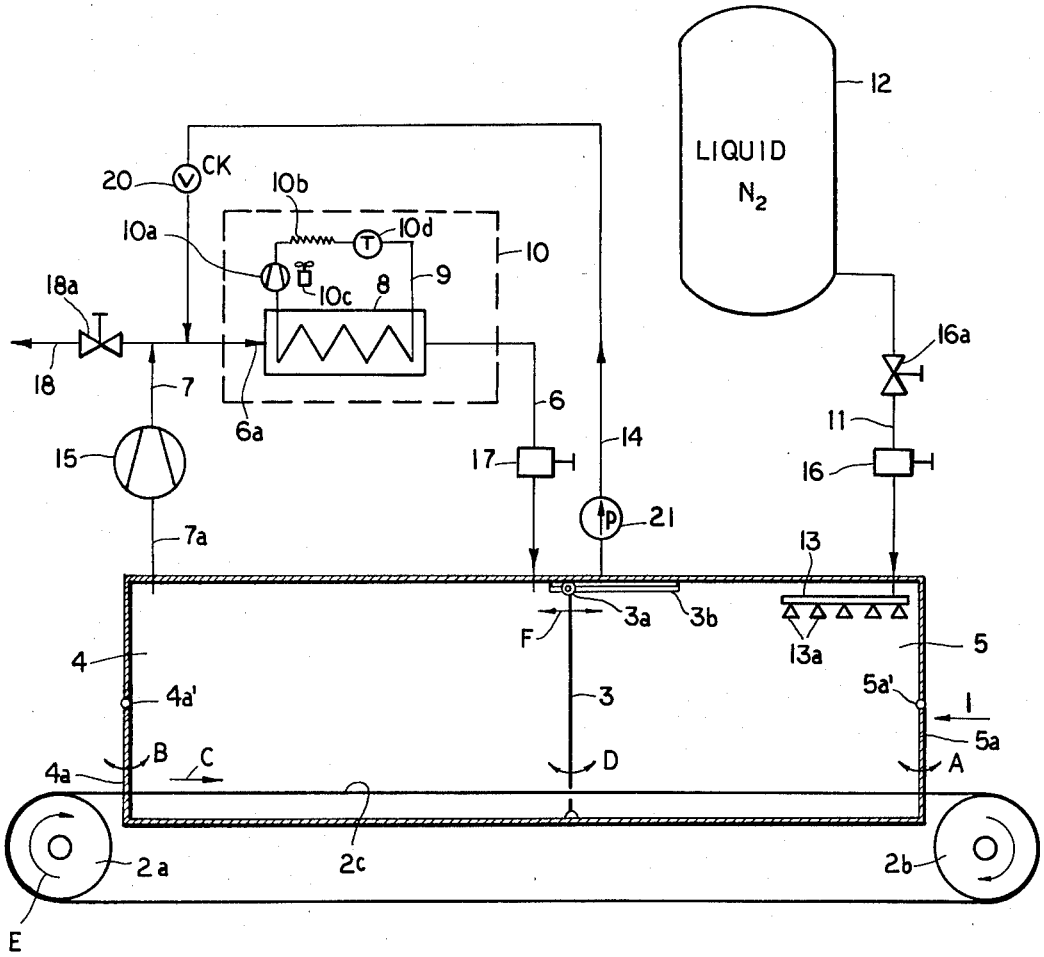
LIQUID
$N_2$
12
20
CK
10b
10d
10a
10
10c
8
9
18a
18
7
6a
6
15
17
14
21
16a
11
16
7a
13
3a
3b
F
13a
5
4
4a'
3
5a'
1
5a
4a
B
C
D
A
2a
2c
2b
E

METHOD OF AND APPARATUS FOR THE COOLING OF ARTICLES OR MATERIALS

This is a continuation of application Ser. No. 850,802, filed Nov. 11, 1977 and now abandoned.

FIELD OF THE INVENTION

The present invention relates to a method of and to an apparatus for the cooling of articles or materials, hereinafter referred to generally as objects, in a cooling apparatus provided with a precooling zone and a deep-cooling zone. Within the cooling zones, the objects are subjected to direct heat exchange with respective gas streams.

BACKGROUND OF THE INVENTION

In the deep cooling of articles and materials, e.g. rubber tires or synthetic-resin scraps to enbrittle them prior to comminution or also in the preparation of frozen foods and the like, it is known to contact the objects, namely, the articles and materials, with a cooling gas by direct heat exchange.

In prior-art processes of this type, the objects can be cooled to a point in which they are embrittled sufficiently to allow the comminution or milling thereof.

In commonly assigned application Ser. No. 648,100 filed Jan. 12, 1976 by two of the present joint inventors (now U.S. Pat. No. 4,072,026), there is described a combined cooling process in which the objects are passed in counterflow to a first cooling-gas stream over part of the cooling zone and a low-temperature or deep-cooling second gas stream is introduced at the cold end of the zone and has a substantially lower temperature than the first gas stream. After heat exchange with the objects or materials in the deep-cooling zone, the two gas streams are mixed within a region of the cooling path.

This combined cooling process, which has considerable advantages over still earlier systems, is characterized by the primary advantage that the necessary low temperature can be generated from two independent sources as required by the conditions to be maintained in the cooling path.

This permits the delivery of a large amount of cold to the apparatus and enables the apparatus to be able to handle different cooling rates, various materials and the like.

Experience with this combined process has, however, shown that the temperature distribution along the cooling path can be readily adjusted to suit the particular objects to be cooled but that this is only the case when the mixing of the two gas streams in the cooling path is carried out such that they have the same temperature. This can only be achieved by varying the position and nature of the mixing zone within the cooling path and by admitting the first cooling-gas stream into the cooling path at various locations, or by using relatively expensive control systems for the two gas streams.

OBJECTS OF THE INVENTION

It is the principal object of the present invention to provide a method of and an apparatus for the cooling of objects in the manner described which enables the temperature distribution within the cooling path to be established precisely without expensive control systems.

It is another object of the invention to provide a method of and an apparatus for the cooling of objects in which the cooling process can be readily varied in accordance with the cooling requirements and the objects to be cooled so as to be economical for a wide range of objects and varying quantities thereof, i.e. varying throughputs of the apparatus.

SUMMARY OF THE INVENTION

These objects are attained, in accordance with the present invention, in a cooling process, especially for the embrittlement of objects in order to enable them to be readily comminuted, especially the chilling or embrittlement of relatively soft or pliable materials, wherein the objects are displaced through a cooling path which is subdivided into a precooling zone and a deep-cooling zone through which the objects are successively passed. The cooling-gas streams traverse these zones in counterflow to the objects and, in the precooling zone, the objects are contacted with a first cooling-gas stream which is advantageously produced by passing the first cooling-gas stream, prior to its entry into the precooling zone, through an indirect heat exchanger which can be cooled by a secondary fluid independent of the first cooling gas. Within the deep-cooling zone, the objects are contacted with a second cooling-gas stream derived from a liquefied gas, namely, expanded or evaporated liquid gas; the second gas stream, after at least partial heat exchange with the objects in the deep-cooling zone, is drawn off and fed to the first cooling-gas stream before the cooling of the latter by the indirect heat exchange mentioned previously.

The withdrawal of the second cooling-gas stream from the deep-cooling zone after at least partial heat exchange with the objects therein and its mixture with the first cooling-gas stream outside of the precooling zone and, more generally, outside of the cooling path but prior to the cooling of this first cooling-gas stream by indirect heat exchange, affords significant advantages over the process described in the aforementioned patent. This is the case notwithstanding the fact that even in this prior system, the necessary cold is generated in two cooling-gas streams which can be derived separately.

Since the mixing does not occur within the cooling path but is a result of mixing the second cooling-gas stream with the first before the cooling of the latter by indirect heat exchange, economical use of the system does not require that the two cooling-gas streams be of the same temperature at mixing.

When the second cooling-gas stream at the point at which it mixes with the first cooling-gas stream or, more generally, at the point at which it is withdrawn from the deep-cooling zone, is warmer than the first cooling-gas stream at its inlet into the precooling zone, the indirect heat exchange is capable of compensating from the warmer condition of the second gas stream. On the other hand, when the second cooling-gas stream is colder, upon its extraction from the deep-cooling zone, than the first cooling-gas stream at its admission to the precooling zone, it contributes cold to the first cooling-gas stream on mixing and reduces the energy demand of the refrigeration installation which is used to cool the first cooling-gas stream by indirect heat exchange.

It has been found to be especially advantageous, according to the present invention, to generate the cold gas of the second cooling-gas stream by spraying the fluid in liquid form into the deep-cooling zone from one or more spray nozzles or locations which can be spaced from the cold end of this zone inwardly along the path.

The spray nozzles can be disposed in the deep-cooling zone in accordance with the desired final temperature of the objects to be cooled. This ensures that the objects upon leaving the deep-cooling zone are sufficiently cooled, i.e. are chilled to the full interiors of these objects and not merely superficially. It has also been found to be advantageous to derive the first cooling-gas stream at least in part by circulation of the gas which emerges from the precooling zone at the warm end thereof. This enables residual cold of the first cooling gas to be utilized economically.

In accordance with the apparatus aspects of the invention, the precooling and final-cooling zones are provided in a cooling chamber having means for enabling the displacement of the articles or materials in counterflow to the cooling gases. This cooling chamber is provided with feed conduits for the cooling gases of which one is connected to a heat exchanger formed as an evaporator for a refrigeration unit in which a refrigerant, independent of the cooling gases, is circulated. The other inlet in connected with a supply vessel for the liquefied cooling gas. The liquefied cooling gas may be liquid nitrogen, liquid oxygen, liquid air, or a liquefied inert gas or mixtures thereof.

Advantageously, the cooling chamber is subdivided into the precooling zone and the final- or deep-cooling zone by at least one partition. The duct from the evaporator or heat exchanger is connected with the cold end (downstream end) of the precooling zone while the duct communicating with the supply vessel for the liquefied gas is connected with the downstream end or cold end of the final- or deep-cooling zone.

At the upstream or warm end of the deep-cooling zone, there is provided a gas outlet duct which opens at the inlet side of the evaporator of the refrigeration installation to admix the second gas stream with the first gas stream. The refrigeration installation for the cooling of the first gas stream by indirect heat exchange can be any conventional refrigeration system.

According to the invention, the cooling chamber is a horizontally disposed cooling tunnel through which the objects are displaced by a transport device preferably in the form of a continuous or endless-belt conveyor.

The cooling tunnel has been found to be especially effective for the freezing of biological substances. In many cases, an upright cooling chamber in the form of a vertical cooling shaft can be provided with a helical or spiral ramp down which objects can slide while the cooling gases pass upwardly. Such a construction has been found to be particularly effective for the chilling of old vehicle tires which are to be ground up for scrap rubber or other purposes. In this case, the objects can descend along the ramp under their own weight.

An advantageous embodiment of the present invention provides that the liquefied cryogen is introduced from the supply vessel into the deep-cooling zone through a spray arrangement which comprises a plurality of spray nozzles spaced apart from the cold end of the deep-cooling zone toward the warm end thereof.

Since the objects are thereby sprayed from a plurality of locations, it is possible to calculate the quantity of liquefied gas per kilogram or piece of the objects to be embrittled to be delivered at each of the spaced apart locations provided with a respective nozzle so that, when the objects leave the deep-cooling zone, they have the desired superficial and internal temperatures and any desired temperature gradient between the surface and the interiors of the objects.

It has been found that optimum results are obtained from an economical standpoint, both with respect to the quantity used and the utilization of the supplied cooling energy when, at the upstream end of the precooling zone, a gas outlet duct is provided from which the first gas stream is drawn, this duct including a compressor for recirculating a portion of this first cooling-gas stream through the evaporator or indirect heat exchanger of the refrigeration unit.

The process of the present invention can be used for the cooling of various objects or materials and has been found to be highly effective for the freezing of biological substances as well as for the embrittlement of old material such as plastic scraps and rubber, e.g. old tires, prior to the comminution thereof. Biological specimens such as blood or the like, adapted to be stored at low temperatures, can also be economically cooled by the apparatus and process of the present invention.

The process and apparatus of the invention can also be used to deep freeze foods, for freeze drying of comestibles or biological materials, for the shrinking of large quantities of rivets prior to the setting thereof, and for the cooling of hot products which are produced by heating or heat-generating processes. For example, red lead can be optimally cooled by the method and apparatus described. A preferred use of the method and apparatus of the present invention is the cooling and embrittlement of large-volume objects which cannot be completely cooled by liquefied gases in an economical manner.

BRIEF DESCRIPTION OF THE DRAWING

The above and other objects, features and advantages of the present invention will become more readily apparent from the following description, reference being made to the accompanying drawing, the sole FIGURE of which is a flow diagram of an apparatus for carrying out the process of the present invention.

SPECIFIC DESCRIPTION

In the drawing, there is shown a cooling tunnel 1 which is traversed by the cooling gases from right to left and by the objects to be cooled from left to right (arrow C).

Through the cooling tunnel 1 there extends the upper stretch 2*c* of an endless conveyor belt 2 passing over a pair of rollers 2*a* and 2*b* which are driven in the clockwise sense represented by the arrow E. At the upstream or warm end of the precooling zone 4, a flap 4*a* is hinged at 4*a'* so as to swing as represented by the arrow B and admit the objects into the cooling tunnel in succession.

At the cold or downstream end of the deep- or final-cooling zone 5, there is provided a similar flap 5*a* hinged at 5*a'* to swing as represented by the arrow A and discharge the chilled objects.

Within the tunnel, there is provided a swingable partition 3, which is hinged at 3*a* on a rail 3*b* to allow at least limited adjustment of the position of this partition as represented by the arrow F. The partition 3 can swing as represented by the arrow D to permit the objects to pass from the precooling zone into the deep-cooling zone 5. The position of the partition 3 affects the temperature distribution along the cooling path or tunnel 1 which is traversed by the objects on the conveyor belt 2*c*.

At the cold or downstream end of the precooling zone 4 of the cooling tunnel 1, there is connected a cooling-gas supply line 6 provided with a control valve 17 which receives the first cooling gas from an indirect heat exchanger 8 which is constituted as the evaporator of a compression refrigeration unit 10. The independent refrigerant cycle is connected to the evaporator 8 by a line represented at 9. The refrigeration installation 10, greatly simplified in the drawing, can include a compressor 10*a* for the refrigerant and a condenser 10*b* as well as an expansion valve 10*d* if required. Heat is dissipated from the condenser 10*b* by a blower 10*c*. The refrigeration installation 10 is, of course, conventional in the art and requires no detailed description.

The first cooling-gas stream which is admitted at 6*a* to the evaporator 8 is derived from a cold-gas stream which is either not circulated or, preferably, from a line 7 and a compressor 15 connected to the outlet duct 7*a* opening at the upstream or warm end of the precooling zone 4. The recirculated first gas stream, heated in indirect heat exchange with the object in the precooling zone and by compression in compressor 15, is cooled in the evaporator 8.

At the cold right-hand end of the deep-cooling zone 5, a line 11, provided with a control valve 16*a* and a needle valve 16, delivers a precisely controlled flow of the liquid cryogen, e.g. liquid nitrogen, to a spray unit 13 which comprises spray nozzles 13*a* spaced apart from the cold end toward the warm end of this zone.

The liquefied gas is sprayed onto the objects and evaporates upon spraying or in contact therewith to produce the second cooling-gas stream which flows through the deep-cooling zone 5 to an outlet 14 which delivers the second cooling gas, partially warmed in direct heat exchange with the objects, into the duct 6*a* where it mixes with the first cooling-gas stream prior to its entry into the evaporator 8.

A vent 18 and a valve 18*a* discharges excess warm gas from the system. A check valve 20 in line 14 prevents warm gas from being blown into the deep-cooling zone 5 and a blower 21 may be provided to force the second gas stream along the duct 14.

The aforedescribed array of spray nozzles 13*a* ensures complete cooling of the objects and at least cooling thereof to their interiors to the desired degree.

The liquefied gas sprayed at 13 onto the objects has a substantially lower temperature than the first cooling-gas stream which is introduced at 6 to the cold end of the precooling zone 4. Preferably, the liquefied gas is liquid nitrogen as has already been noted and enters the deep-cooling zone 5 at a temperature of about 80° K. Other liquefied gases such as carbon dioxide or argon can be used, depending upon the nature and degree of cooling of the objects.

Using a conventional compressor-type refrigeration unit 10 to cool the first gas stream by indirect heat exchange, it is possible to attain a temperature at the inlet of duct 6 to the precooling zone of about 210° K. Other temperatures for the first cooling-gas stream can, of course, be attained by using other conventional refrigeration units. For example, when an absorption refrigeration unit is employed, this temperature can be reduced still further.

The control valves 16 and 17 regulate the supply of liquefied gas and first cooling gas to the respective zones as well as the proportions of the two gases which are mixed. The warm gas discharged via line 18 will, of course, correspond to the gas supplied by the spray nozzles 13*a*.

We claim:

1. A method of cooling objects which comprises:

(a) passing said objects through a cooling chamber in one direction;

(b) introducing a first cooling-gas stream into said chamber at a relatively upstream location and passing said first cooling-gas stream in direct heat-exchange relation with said objects;

(c) generating a second cooling-gas stream by evaporation and expansion of a liquefied gas and passing said second gas stream in direct heat-exchanging relation with the precooled objects at a location downstream from said upstream location;

(d) withdrawing said second gas stream from said downstream location after at least partial heat exchange between said second gas stream and said objects;

(e) passing said first cooling-gas stream in indirect heat exchange with a coolant other than said gas streams prior to the introduction of said first cooling-gas stream into said chamber at said upstream location;

(f) mixing the withdrawn second gas stream with said first gas stream prior to its indirect heat exchange with said coolant; and (g) venting a portion of said first cooling-gas stream from a warm end of said upstream location corresponding to the quantity of said second cooling-gas stream introduced into said downstream location.

2. The method defined in claim 1 wherein said coolant is a refrigerant, in a closed refrigeration cycle which has an evaporator in which said first cooling-gas stream is subjected to indirect heat exchange.

3. The method defined in claim 1 wherein said second cooling-gas stream is generated by spraying liquefied gas into said downstream location from a plurality of nozzles which can be disposed in said downstream location in accordance with the desired final temperature of the objects to be cooled.

4. The method defined in claim 3, further comprising withdrawing at least a portion of said first cooling-gas stream from said upstream location at said warm end thereof and recirculating the withdrawn first cooling-gas stream to said evaporator for mixture with the withdrawn second gas stream.

5. An apparatus for the cooling of objects, comprising:

a horizontal cooling tunnel forming a cooling chamber;

means for displacing objects progressively through said chamber in one direction from an upstream location constituting a precooling zone in said chamber to a downstream location constituting a deep-cooling zone of the chamber;

a first conduit connected to said upstream location of said chamber for admitting a first cooling-gas stream to said chamber and passing said first cooling-gas stream in direct heat exchange with said objects at said upstream location to precool said objects;

a second conduit connected to a source of liquefied gas and communicating with said downstream location of said chamber for admitting a second cooling-gas stream to said downstream location to flow in direct heat exchange with the precooled objects to finish-cool the same;

a spray device having a plurality of nozzles spaced in the direction of displacement of said objects for spraying said liquefied gas on said objects, said liquefied gas vaporizing in said deep-cooling zone to constitute said second gas stream into said downstream location;

a closed-cycle refrigeration unit having an evaporator connected to said first conduit for the indirect cooling of said first gas stream prior to its admission to said upstream location; and an outlet connected to said downstream location and delivering a second cooling gas upon at least partial warming thereof in heat exchange with objects in said downstream location to said evaporator for mixture with said first gas stream prior to its passage into indirect heat exchange with said evaporator.

6. The apparatus defined in claim 5 further comprising another outlet connected to said warm end of said upstream location for recirculating warmed first cooling-gas stream to said evaporator for mixture with said second cooling gas introduced into the latter.

7. The apparatus defined in claim 6 wherein said other outlet is provided with a compressor.

8. The apparatus defined in claim 7 wherein said tunnel is provided with a partition between said zones and a conveyor extending through said tunnel for displacing said objects therethrough and constituting said displacing means.

* * * * *